US005236086A

United States Patent [19]

MacTaggart

[11] Patent Number: 5,236,086

[45] Date of Patent: Aug. 17, 1993

[54] GUN CONTAINMENT DEVICE

[75] Inventor: Richard K. MacTaggart, Renner, S. Dak.

[73] Assignee: Superior Concrete Pumping (1984) Ltd., Canada

[21] Appl. No.: 956,625

[22] Filed: Oct. 5, 1992

[51] Int. Cl.[5] ..... B65D 25/10

[52] U.S. Cl. ..... 206/317; 312/217

[58] Field of Search ..... 70/63, 70, 71; 109/39, 109/47, 59 R, 59 T, 63, 63.5; 206/317, 1.5; 312/216-218

[56] References Cited

U.S. PATENT DOCUMENTS

| | | | |
|---|---|---|---|
| 1,932,638 | 10/1933 | Rogers | 206/317 |
| 3,307,755 | 3/1967 | Lentz | 206/317 |
| 3,731,818 | 5/1973 | Young | 206/317 |
| 4,768,021 | 8/1988 | Ferraro | 70/63 |
| 4,800,822 | 1/1989 | Adkins | 105/59 R |
| 5,009,088 | 4/1991 | Cislo | 70/63 |
| 5,048,682 | 9/1991 | Taylor | 206/317 |
| 5,111,755 | 5/1992 | Rouse | 109/59 R |
| 5,118,175 | 6/1992 | Costello | 206/317 |
| 5,161,396 | 11/1992 | Loeff | 206/317 |
| 5,168,994 | 12/1992 | Beletsky et al. | 206/317 |

*Primary Examiner*—Jimmy G. Foster
*Attorney, Agent, or Firm*—Davis, Bujold & Streck

[57] ABSTRACT

A hand gun container is disclosed which has a hand gun support secured within an interior cavity of the container. The support has an opening whereby a hand gun is inserted into the support. A locking bar is positioned within the container. The locking bar is movable between a first position across the opening in the support thereby preventing the hand gun from being withdrawn from the support, and a second position spaced from the opening thereby permitting the hand gun to be withdrawn from the support. A lock maintains the locking bar in the first position. The lock has a release switch activated by finger pressure such that the release switch must be kept depressed in order to draw the hand gun past the locking bar. The release switch is positioned adjacent to a trigger of a hand gun in the support and shielded by the relative positioning of the hand gun and the support, such that a person activating the release switch must have fingers long enough to reach around the trigger in order to press the release switch.

6 Claims, 4 Drawing Sheets

GUN CONTAINMENT DEVICE

The present invention relates to a hand gun container.

BACKGROUND OF THE INVENTION

An alarming number of children are killed in the United States while playing with loaded hand guns. Many of these hand guns were kept in locked gun containers, but the children learned how to gain access to these units by watching their parents.

SUMMARY OF THE INVENTION

What is required is a hand gun container having a childproof secondary containment.

According to the present invention there is provided a hand gun container having a hand gun support secured within an interior cavity of the container. The support has an opening whereby a hand gun is inserted into the support. A locking bar is positioned within the container. The locking bar is movable between a first position across the opening in the support thereby preventing the hand gun from being withdrawn from the support, and a second position spaced from the opening thereby permitting the hand gun to be withdrawn from the support. Locking means are disposed in the container for maintaining the locking bar in the first position. The locking means has a release switch positioned deep within the container such that it is practically impossible for the average child to reach the release switch.

The gun container as described addresses the problem of child access to hand guns, by incorporating a release mechanism which is virtually impossible for the average child to reach. The preferred position for the release switch is adjacent to a trigger of a hand gun in the support with the release switch being shielded by the relative positioning of the gun support and the hand gun. A person activating the release switch must have fingers long enough to reach around the trigger in order to press the release switch.

Although beneficial results may be obtained through the use of the gun container as described, some children have unusually long fingers. Even more beneficial results may be obtained if the release switch is activated by finger pressure, such that the release switch must be kept depressed in order to draw the hand gun past the locking bar. The pressure for the release switch is set at a pressure level in excess of 10 pounds such that it is practically impossible for the average child to exert the pressure required to activate the release switch. A child would have to have both exceptionally long fingers and exceptionally strong fingers to activate the release switch.

Although beneficial results may be obtained through the use of the gun container as described, these precautions will not prevent a child from making an attempt to withdraw a hand gun from the container. Even more beneficial results will therefore be obtained when in the first position the locking bar lies across the hammer of a hand gun positioned in the hand gun support, thereby preventing the hand gun from being fired while in the gun container.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
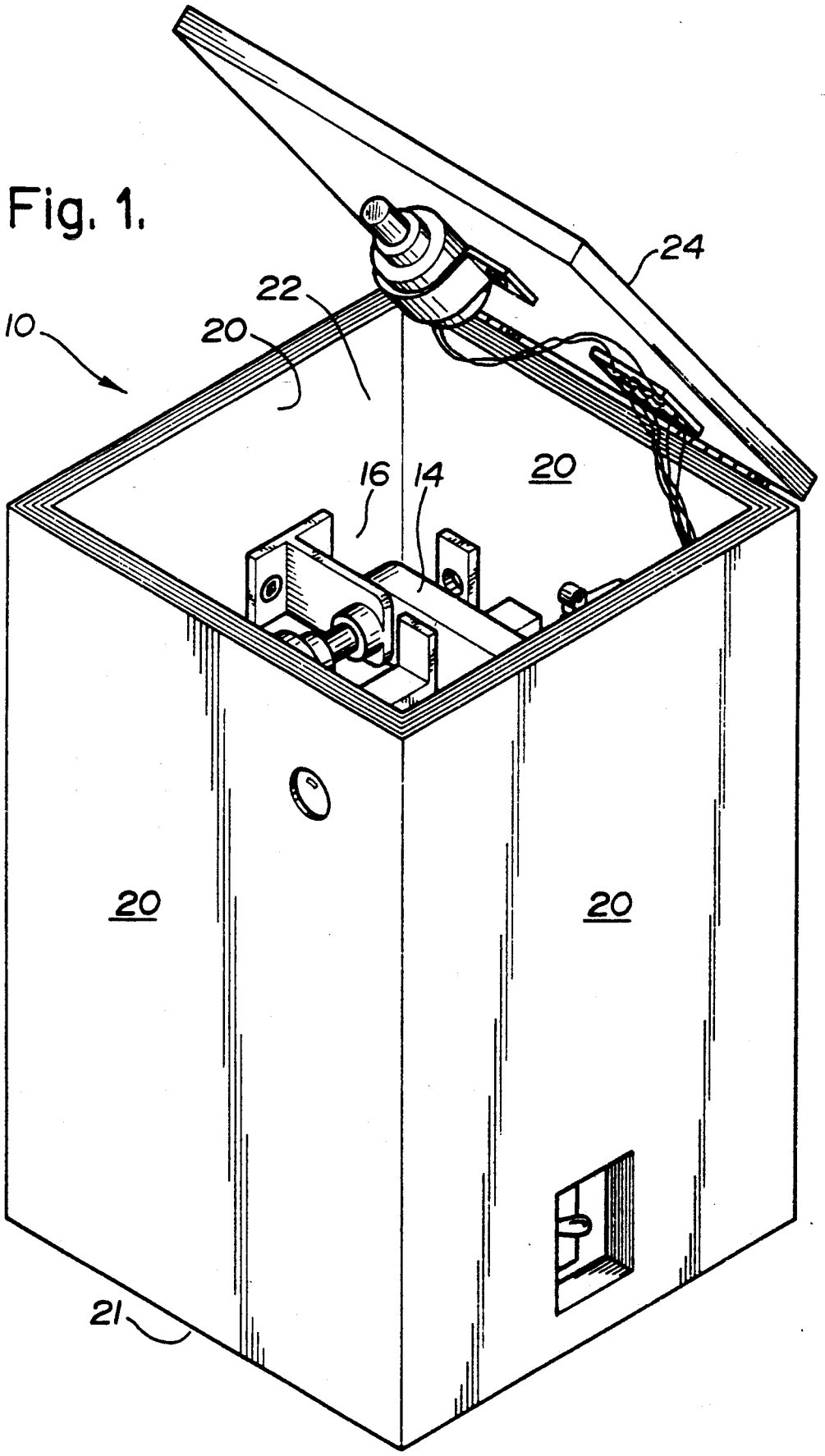
FIG. 1 is a perspective view of a gun container constructed in accordance with the teachings of the present invention.

The preferred embodiment, a hand gun container generally identified by reference numeral 10, will now be described with reference to FIGS. 1 through 4.

Figure 2:
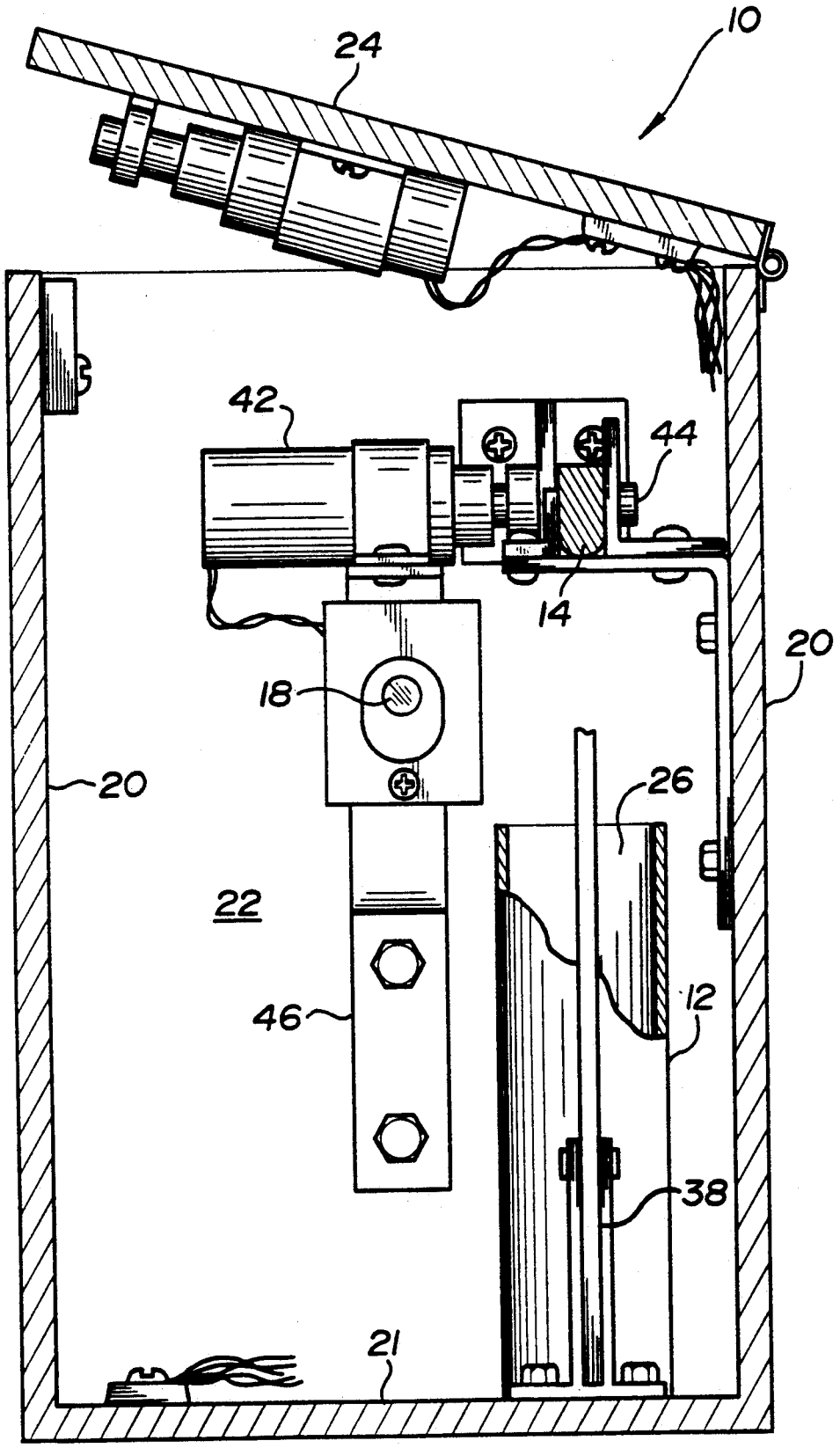
FIG. 2 is a longitudinal section view of the gun container illustrated in FIG. 1
Figure 3:
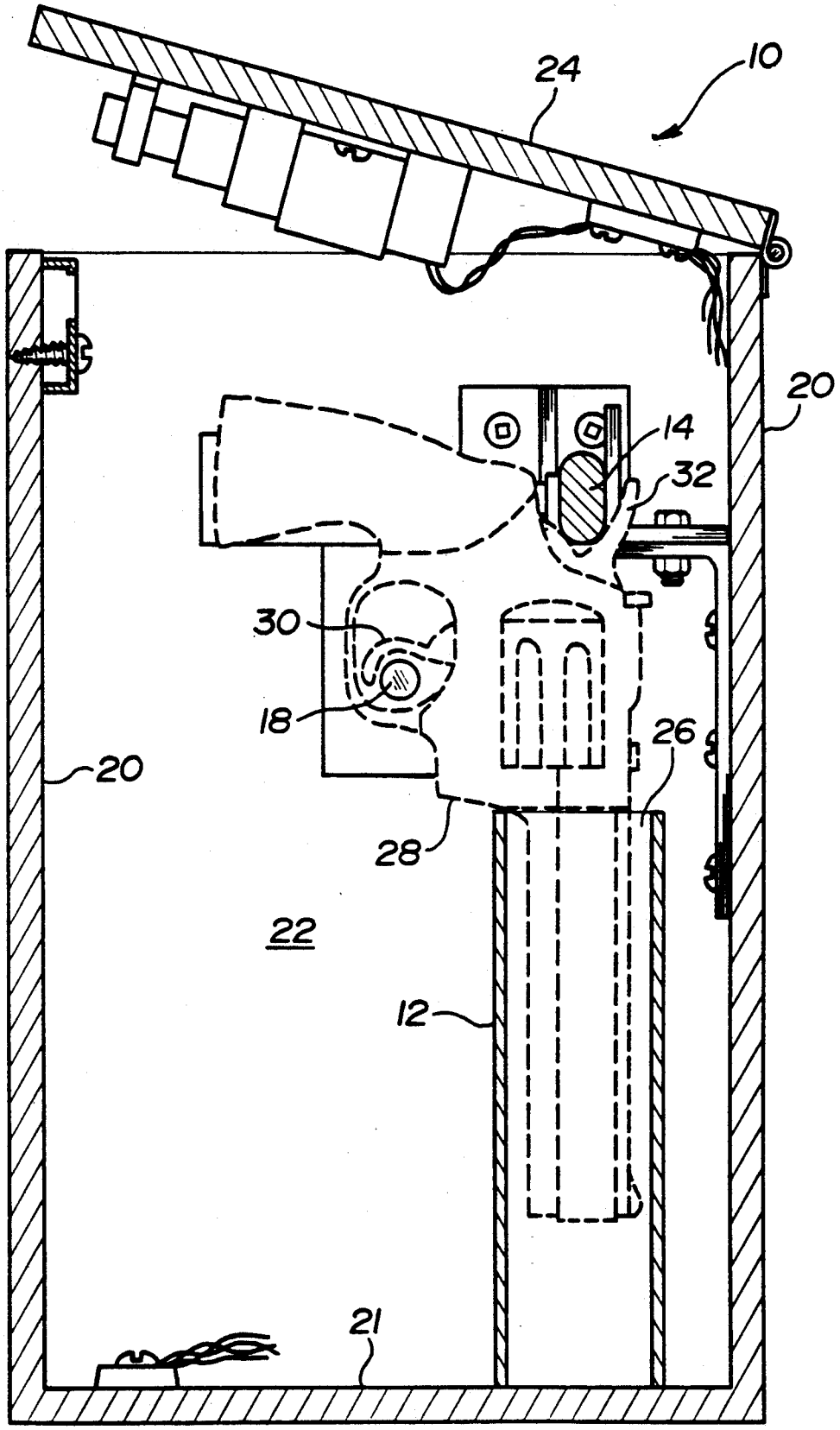
FIG. 3 is a longitudinal section view of the gun container illustrated in FIG. 2, with a gun illustrated in a stored position.
Figure 4:
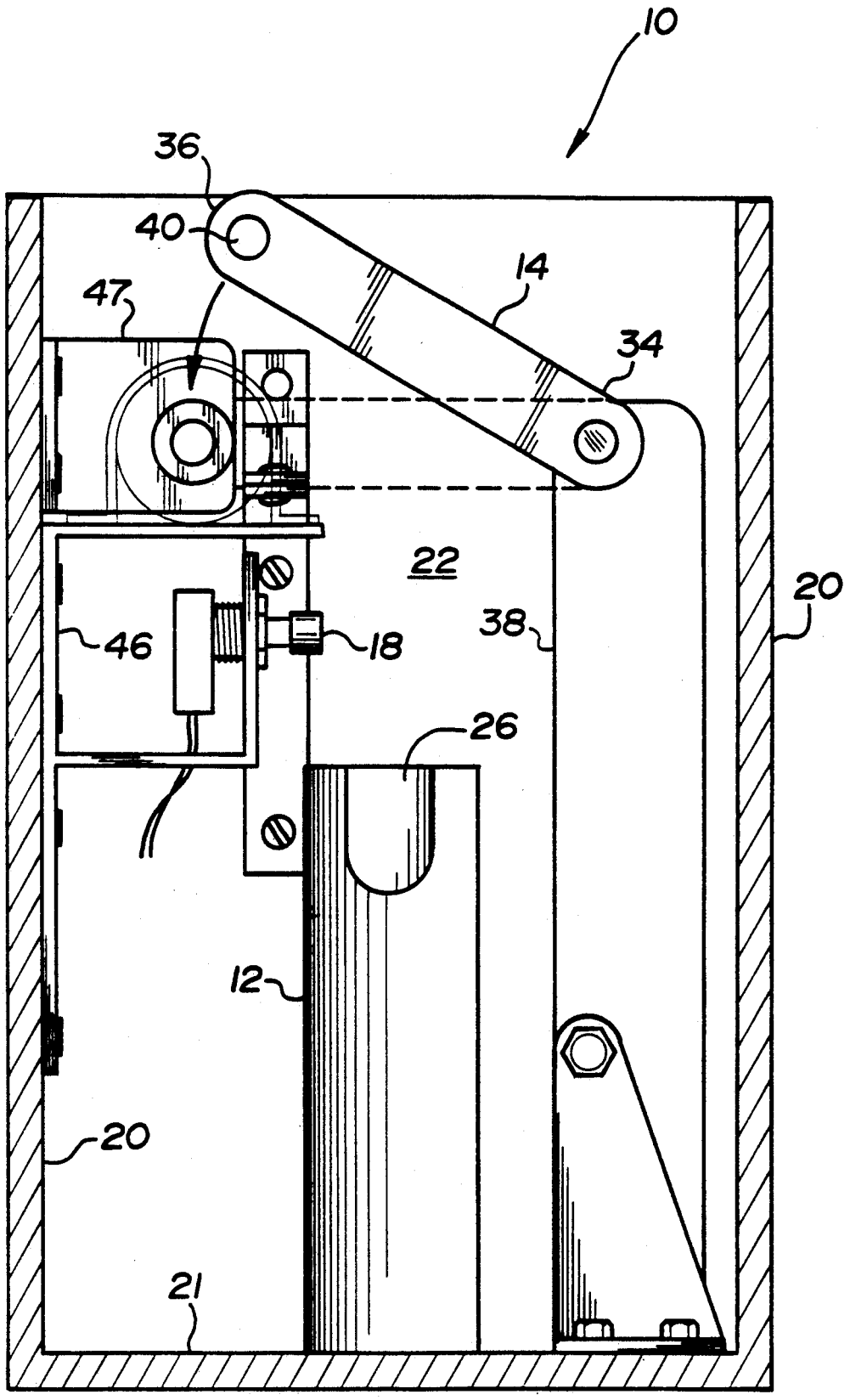
FIG. 4 is an alternate longitudinal section view of the gun container illustrated in FIG. 1.

Referring to FIG. 2, the primary components of hand gun container 10 are hand gun support 12, locking bar 14, lock assembly 16, and release switch 18. Container 10 has a plurality of sidewalls 20 and a bottom 21 which define an interior cavity 22. Interior cavity is closed by a hinged closure door 24. Support 14 is secured within interior cavity 22 of container 10, preferably by bolting to bottom 21. Support 14 has an opening 26 whereby a hand gun 28 is inserted into support 14. Referring to FIG. 3, for the purpose of the description which follows the trigger 30 and hammer 32 of hand gun 28 are identified by separate reference numerals. Locking bar 14 is positioned within interior cavity 22 of container 10. Locking bar 14 has a first end 34 and a second end 36. First end 34 is pivotally mounted to a column 38 positioned adjacent to support 14. Column 38 is secured to bottom 21 of container 10. Locking bar 14 is pivotally movable between a first position across opening 26 in support 14 and a second position spaced from opening 26. Lock assembly 16 consists of a number of components which serve as a locking means to maintain locking bar 14 in the first position. Referring to FIGS. 2 and 4, these components include: a ring 40 positioned on second end 36 of locking bar 14; a solenoid 42 with a reciprocating plunger 44 movable between an extended and a retracted position and which, when extended, engages ring 40; a power source (not shown) and a mounting bracket 46 to which solenoid 42 is secured. Mounting bracket 46 is secured to sidewalls 20 to maintain the relative positioning of solenoid 42 and ring 40 of locking bar 14. Solenoid 42 is activated by release switch 18. When activated plunger 44 moves to a retracted position and is withdrawn from engagement from ring 40 at second end 36 of locking bar 14. Release switch 18 is also secured to mounting bracket 46, in such a manner that it is adjacent trigger 30 when hand gun 28 is in support 14.

The use and the operation of hand gun container 10 will now be described with reference to FIGS. 1 through 4. Referring to FIGS. 1 and 2, closure door 24 is opened to permit access to interior cavity 22 of container 10. It is preferred that closure door be equipped with some sort of locking mechanism and alarm system to let the parent know if the container has been tampered with. Referring to FIG. 3, once closure door 24 is opened hand gun 28 is placed through opening 26 and into support 14. Locking bar 16 is then pivoted into the first position, with ring 40 at second end 36 of locking bar 14 being engaged with plunger 44 of solenoid 42. When locking bar 14 is in the first position locking bar 14 is positioned across opening 26 preventing hand gun 28 from being withdrawn from support 14. It is preferred that locking bar 14 lies across hammer 32 of hand gun 28 to prevent hand gun 28 from being accidentally fired by a child trying to remove hand gun 28 from gun container 10. Release switch 18 must be activated by finger pressure. When release switch 18 is depressed solenoid 42 is activated, causing plunger 44 to be retracted. In the retracted position plunger 44 is removed from ring 40 and there is nothing to impede the pivotal movement of locking bar 14, hand gun 28 may then be drawn past locking bar 14. Release switch 18 must be kept depressed until locking bar 14 has pivoted sufficiently to move ring 40 out of alignment with plunger 44. If release switch is not kept depressed for a sufficient time period plunger 44 will reengage ring 40. A child must have sufficient strength to press release switch 18 and at the same time pull hand gun 28 from support 14. In order to make it more difficult, release switch 18 is positioned adjacent to trigger 30 of hand gun 28 in support 14. Release switch is shielded by the relative positioning of hand gun 28 and support 14. A person activating release switch 18 must have fingers long enough to reach around trigger 30 and press release switch 18. This makes it is practically impossible for the average child to reach release switch 18. Release switch 18 has been made as a pressure switch for an express purpose. The pressure required can be adjusted. It is preferred that the pressure for release switch 18 be set at a pressure level in excess of 10 pounds. It has been found that it is practically impossible for the average child to exert finger pressure in excess of 10 pounds to activate release switch 18.

It will be apparent to one skilled in the art that hand gun container 10 as described is substantially child proof. It will also be apparent to one skilled in the art that modifications may be made to the illustrated embodiment without departing from the spirit and scope of the invention as defined in the claims.

The embodiments of the invention in which an exclusive property or privilege is claimed are defined as follows:

1. A hand gun container, comprising:

a. a container having an interior cavity;

b. a hand gun support secured within the interior cavity of the container, the support having an opening whereby a hand gun is inserted into the hand gun support;

c. a locking bar positioned within the hand gun container, the locking bar being movable between a first position across the opening in the support thereby preventing the hand gun from being withdrawn from the support, and a second position spaced from the opening thereby permitting the hand gun to be withdrawn from the support; and d. locking means disposed in the container for maintaining the locking bar in the first position, the locking means having a release switch, the release switch being positioned within the interior cavity of the container in proximity to the hand gun support such that when a hand gun is positioned in the hand gun support the release switch is shielded by the hand gun and a person must reach around the hand gun to activate the release switch.

2. The gun container as defined in claim 1, the release switch being positioned adjacent to a trigger of a hand gun in the support and shielded by the relative positioning of the gun support and the hand gun, such that a person activating the release switch must reach around the trigger in order to press the release switch.

3. The gun container as defined in claim 1, the release switch being activated by finger pressure such that the release switch must be kept depressed in order to draw the hand gun past the locking bar, the pressure for the release switch being set at a pressure level in excess of 10 pounds.

4. The gun container as defined in claim 1, in the first position the locking bar lying across the hammer of a hand gun positioned in the hand gun support, thereby preventing the hand gun from being fired while in the gun container.

5. A hand gun container, comprising:

a. a container having an interior cavity;

b. a hand gun support secured within the interior cavity of the container, the support having an opening whereby a hand gun is inserted into the hand gun support;

c. a locking bar positioned within the hand gun container, the locking bar being movable between a first position across the opening in the support thereby preventing the hand gun from being withdrawn from the support, and a second position spaced from the opening thereby permitting the hand gun to be withdrawn from the support, in the first position the locking bar lying across a hammer of a hand gun positioned in the hand gun support, thereby preventing the hand gun from being fired while in the gun container; and d. locking means disposed in the container for maintaining the locking bar in the first position, the locking means having a release switch activated by finger pressure such that the release switch must be kept depressed in order to draw the hand gun past the locking bar, the release switch being positioned within the interior cavity of the container in proximity to the hand gun support such that when a hand gun is positioned in the hand gun support the release switch is shielded by the hand gun and a person must reach around the hand gun in order to press the release switch.

6. A hand gun container, comprising:

a. a container having an interior cavity;

b. a hand gun support secured within the interior cavity of the container, the support having an opening whereby a hand gun is inserted into the hand gun support;

c. a locking bar positioned within the hand gun container, the locking bar being movable between a first position across the opening in the support thereby preventing the hand gun from being withdrawn from the support, and a second position spaced from the opening thereby permitting the hand gun to be withdrawn from the support, in the first position the locking bar lying across a hammer of a hand gun positioned in the hand gun support, thereby preventing the hand gun from being fired while in the gun container; and d. locking means disposed in the container for maintaining the locking bar in the first position, the locking means having a release switch activated by finger pressure such that the release switch must be kept depressed in order to draw the hand gun past the locking bar, the release switch being positioned within the interior cavity of the container in proximity to the hand gun support such that when a hand gun is positioned in the hand gun support the release switch is shielded by the hand gun and a person must reach around a trigger of the hand gun in order to press the release switch, the pressure of the release switch being set at a pressure level in excess of 10 pounds.

* * * * *